US006063266A

United States Patent [19]

Grande et al.

[11] Patent Number: 6,063,266

[45] Date of Patent: May 16, 2000

[54] PROCESS FOR REMOVING ESSENTIALLY NAPHTHENIC ACIDS FROM A HYDROCARBON OIL

[75] Inventors: Knut Grande; Carsten Sorlie, both of Trondheim, Norway

[73] Assignee: Den norske stats oljeseskap a.s., Stavanger, Norway

[21] Appl. No.: 08/793,662

[22] PCT Filed: Aug. 29, 1995

[86] PCT No.: PCT/NO95/00142

§ 371 Date: Feb. 27, 1997

§ 102(e) Date: Feb. 27, 1997

[87] PCT Pub. No.: WO96/06899

PCT Pub. Date: Mar. 7, 1996

[30] Foreign Application Priority Data

Aug. 29, 1994 [NO] Norway ..... 943188

[51] Int. Cl.[7] ..... C10G 17/00

[52] U.S. Cl. ..... 208/263; 208/189

[58] Field of Search ..... 208/263, 189

[56] References Cited

U.S. PATENT DOCUMENTS 2,921,023 1/1960 Holm ..... 208/263

FOREIGN PATENT DOCUMENTS

96/06899 7/1996 Norway ..... 208/263

*Primary Examiner*—Helane Myers
*Attorney, Agent, or Firm*—Kirkpatrick & Lockhart LLP

[57] ABSTRACT

A process for removing essentially naphthenic acids from a crude oil which has not previously been fractionated by distillation, or from which only a naphtha fraction has been distilled. The crude oil is hydrogenated at 1–50 bars and 100–300° C. over a catalyst of the kind used for hydrogenation of atmospheric residue oils. As a catalyst, especially Ni—Mo or Ni—Co deposited on alumina as a carrier material is used.

23 Claims, 1 Drawing Sheet

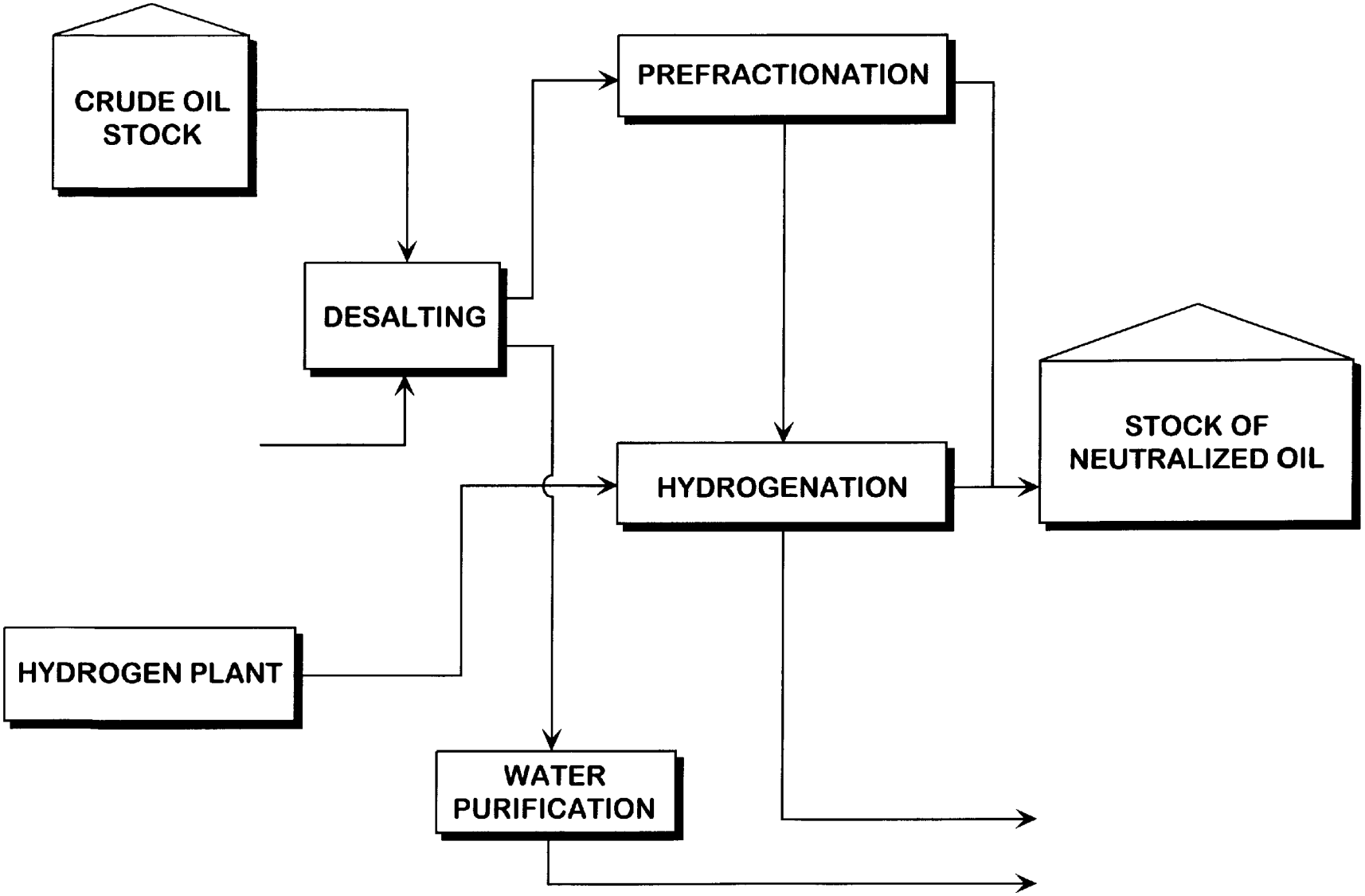
CRUDE OIL STOCK
DESALTING
PREFRACTIONATION
HYDROGENATION
STOCK OF NEUTRALIZED OIL
HYDROGEN PLANT
WATER PURIFICATION

PROCESS FOR REMOVING ESSENTIALLY NAPHTHENIC ACIDS FROM A HYDROCARBON OIL

The present invention relates to a process for removing essentially naphthenic acids from a hydrocarbon oil, more specifically from a crude oil which has not previously been distilled into fractions, or from a crude oil in which only a naphtha fraction has been distilled.

It is well known that crude oil and crude oil fractions contain sulphur compounds, nitrogen compounds and other undesired compounds, and a large number of processes have been proposed for removing such compounds from crude oil fractions. Catalytic hydrogenation is a very commonly used method for removing i.a. sulphur and nitrogen content. Such hydrogenations of naphtha fractions are typically carried out at pressures of e.g. 10 to 30 bars and temperatures of 250 to 350° C., whereas corresponding treatments of distillates are carried out at pressures of 20 to 80 bars and temperatures of 270° C. to 400° C., and treatments of residue oils are carried out at pressures of 100 to 150 bars and temperatures of 300° C. to 450° C. Such hydrogenation treatments also remove any naphthenic acids contained in the hydrocarbon fraction. The term naphthenic acids is used herein as a common designation for naphthenic, aromatic and paraffinic carboxylic acids.

It may often be strongly desired to remove particularly naphthenic acids from hydrocarbon oils, because they have a strong corrosive action on the process equipment. For that reason it would be desirable to eliminate the naphthenic acids as early as possible in the oil refining process.

It is has now been discovered that it is possible to carry out such removal of the naphthenic acids from a non-fractioned or only topped crude oil by a selective hydrogenation of the naphthenic acids under very mild conditions. Under such mild conditions, any substantial amount of desulphuration reactions, denitrification reactions and reactions leading to saturation of aromatics, is avoided, which results in a moderate hydrogen consumption.

Thus, the invention provides a process for removing essentially naphthenic acids from a hydrocarbon oil, in which process the hydrocarbon oil is hydrogenated at an elevated temperature over a catalyst of the kind used for hydrogenation of atmospheric residue oils, preferably a catalyst consisting of nickel-molybdenum or cobalt-molybdenum, deposited on alumina as a carrier material. The process is characterized by there being used as hydrocarbon oil:

(a) a crude oil which has not previously been distilled into fractions, or (b) a crude oil from which a naphtha fraction has been distilled, and by the hydrogenation being carried out at 1 to 50 bars and 100° C. to 300° C.

In both embodiments of the process of the invention it is preferred to carry out the hydrogenation at 20 to 30 bars and at a temperature of 200° C. to 250° C.

The hydrogenation is suitably effected in one or more parallel reactors having a fixed catalyst bed. As mentioned, the catalysts utilized in the process of the invention are such catalysts which have proved to be suitable for hydrogenation of atmospheric residue oils. It is important for a successful carrying out of the process that the carrier material of the catalyst is sufficiently porous to allow penetration of even the heaviest part of the crude oil into the catalyst pores. Therefore, the carrier material should have a porosity such that the final supported catalyst preferably has a porosity of the magnitude 10 to 12 nanometers (nm). Particularly useful catalysts comprise nickel-molybdenum or cobalt-molybdenum deposited on alumina as a carrier material. The oil flow through the catalyst is preferably 0.5 to 5.0 $m^3$ oil per $m^3$ catalyst per hour, most preferred 1.0 to 3.0 $m^3$ oil per $m^3$ catalyst per hour.

As a pretreatment of the crude oil it may be advantageous to carry out a conventional desalting of the crude oil with water.

The process of the invention allows a selective reduction of the content of naphthenic acids in the crude oil to less than about 5 to 6%, without simultaneous hydrogenation of sulphur compounds and nitrogen compounds which may be present. Concurrently with a strong reduction of the content of naphthenic acids, a certain reduction of the metal content in the crude oil also takes place. This is no disadvantage; especially not if the hydrogenated crude oil is to be processed for example in a catalytic cracker, because the catalyst utilized in the hydrogenation process has a much higher metal tolerance than the catalyst employed in a cracking process. Therefore, if the crude oil is to be subjected to cracking, it may be advantageous to carry out the process of the invention at a temperature which is sufficiently high to achieve even a substantial reduction of the metal content, even though such higher temperature would result in a stronger reduction of the sulphur and nitrogen content and consequently in an increased hydrogen consumption, and possibly would necessitate sulphur recovery and nitrogen removal.

The process of the invention may easily be included as a part of a crude oil refining process for refining acid crude oils. Upon a desalting of the crude oil and heating thereof by heat exchange to 100–300° C., preferably to 230–250° C., the crude oil may be passed through a hydrogenation reactor system 30 for implementation of the process of the invention, whereupon it is passed to the next heat exchangers in the refining process and then to the crude oil boiler and the distillation column. The effective but lenient hydrogenation of essentially naphthenic acids achieved by the process of the invention will delimit the consumption of hydrogen in a crude oil refining process and consequently reduce the costs for hydrogenation reactors compared to previously known and more strict hydrogenation treatments of the crude oil. The costs of integrating the process of the invention with the refining process will amount to only a small fraction of the costs of a traditional complete pretreatment plant. Thus, with the new process incorporated into a crude oil refining process, there will be no need for any additional desalters, heat exchangers and strippers or any additional capacity for waste water treatment.

An example on an embodiment of the process of the invention is described in more detail hereinbelow. The main features of this embodiment are shown in the appended drawing.

Crude oil from a crude oil stock is heated to 100–150° C. and fresh water is added thereto. The mixture of water and crude oil is pumped to a desalter wherein the mixture is separated into oil and water by gravity and by application of an electrical field. Salt-containing water containing also a minor amount of hydrocarbons is passed to a water purification plant and the desalted crude oil is passed to a prefractionation unit. In the prefractionation unit, the lightest part of the oil, e.g. about 15%, is separated out, which part consists of a naphtha fraction having a boiling temperature of up to 100–200° C. Such prefractionation is not strictly required but is preferably effected to improve the operation conditions of the subsequent hydrogenation, because it reduces the hydrocarbon partial pressure as well as the total volumetric flow through the hydrogenation plant.

The bottom fraction from the prefractionation unit is pumped to the hydrogenation unit wherein it is first mixed with a hydrogen-rich recycle gas from said hydrogenation unit and with fresh make-up hydrogen gas from a hydrogen plant, which may be a plant for steam prereforming of natural gas, LPG or naphtha. The mixed feed is fed to e.g. five parallel reactors, each having a fixed catalyst bed containing a catalyst consisting of Ni—Mo on $AL_2O_3$. Upon contact with the catalyst, the carboxyl groups in the crude oil, and particularly the carboxyl groups of the naphthenic acids, react with hydrogen with formation of water. The effluent from the hydrogenation reactors are passed to a high pressure separator. The liquid product from the high pressure separator is passed to a low pressure separator, while the gas from the high pressure separator is recycled to the feed as indicated above. If necessary, the gas which is separated out in the low pressure separator is passed to a sulphur recovery plant, together with a purge stream taken from the above-mentioned recycle gas. The crude oil from the low pressure separator is passed to a stripper wherein the lightest hydrocarbons and any $H_2S$ are stripped off. If necessary, even this gas stream is passed to the sulphur recovery plant. The treated crude oil which is withdrawn from the stripper is mixed with the top fraction which was separated from the crude oil in the prefractionation unit prior to the hydrogenation, and the resulting mixture is passed to a storage tank for neutralized oil.

Suitable process equipment and suitable procedures for carrying out the process of the invention will be essentially similar to those utilized in well known processes for hydrogenation of gas oils, except that equipment in connection with sulphur recovery and nitrogen removal will often not be required for the present process. Persons skilled in the art will easily be able to accommodate known gas oil hydrogenation techniques to the process of the invention.

The invention is shown in more detail in the following examples.

EXAMPLE 1

In a pilot plant for hydrogenation processes comprising a reactor charged with 500 ml of catalyst in a fixed bed, hydrogenation of 0.5 l/h of crude oil was carried out in several runs at a pressure of 20 bars and at temperatures of 230° C., 250° C., 300° C. and 350° C., respectively. The catalyst was Ni—Mo on $Al_2O_3$, having a pore size of 10–12 nanometers. 200 Nl $H_2$ per liter of oil was used and the oil flow through the catalyst was 1.0 liter of oil per liter of catalyst per hour. The untreated crude oil has the following characteristics:

| | |
|---|---|
| Acid number, mg KOH/g oil | 2.6 |
| Metal content, ppm | 10 |
| Sulphur content, ppm | 4572 |
| Nitrogen content, ppm | 541 |

The results obtained with respect to the reduction of the acid number are given in Table 1 below, which alo gives the metal content, the sulphur content and the nitrogen content of the hydrogenated crude oil product.

TABLE 1

| Temp. ° C. | Acid number mg KOH/g | Metal content ppm | Sulphur content ppm | Nitrogen content ppm |
|---|---|---|---|---|
| 230 | 0.15 | 7.5 | 4572 | 542 |
| 250 | 0.07 | 5.5 | 4334 | 525 |
| 300 | 0.06 | 4.2 | 3019 | 510 |
| 350 | 0.15 | 2.9 | 1452 | 506 |

The test results show that it is possible at 230° C. and 20 bars to selectively hydrogenate the naphthenic acids in the crude oil from a content corresponding to an acid number of 2.6 mg KOH/g oil to a content as low as 0.15 mg KOH/g oil. The sulphur compounds and nitrogen compounds in the crude oil were not hydrogenated to any measurable extent and it may be presumed, therefore that the hydrogenation may be performed at a commercial scale without any need for sulphur recovery and nitrogen removal. Concurrently with a strong reduction of the acid number, even a certain reduction of the metal content of the crude oil occurred at 230° C., viz. a reduction from 10 ppm to 7.5 ppm. This represents no disadvantage, particularly not if the hydrogenated crude oil is to be processed for example in a catalytic cracker, because the catalyst utilized in the hydrogenation process has a much higher metal tolerance than the catalyst used in a cracking process.

Even at the higher temperatures, 250° C., 300° C. and 350° C., a very satisfactory reduction of the acid number is also achieved, together with an increasing reduction of the metal content. However, with increasing temperature an increasing hydrogenation of the sulphur compounds and the nitrogen compounds is also taking place. This brings about an increased hydrogen consumption and necessitates sulphur recovery and nitrogen removal, which most often is not desired in connection with the process of the invention.

Tests carried out with the above described untreated crude oil at 230° C., at the above defined conditions, have shown that the catalyst stability, expressed as the total acid number in mg KOH/g, remained approximately constant for a long period of time at a catalyst performance which was satisfactory for commercial operation. The results are given in Table 2 below.

TABLE 2

| Catalyst stability at 230° C. | |
|---|---|
| Days in operation | Total acid number (mg KOH/g) |
| 1 | 0.1 |
| 10 | 0.2 |
| 40 | 0.2 |
| 60 | 0.2 |
| 95 | 0.2 |

A reduction of the acid number of the crude oil to a value lower than 0.5 mg KOH/g is considered sufficient to fulfil the aim of the invention.

EXAMPLE 2

Tests were carried out under the same conditions as in Example 1, except that the operation pressure was increased to 50 bars.

The results obtained with respect to the reduction of the acid number are given in Table 3 below, which table also gives the metal content, the sulphur content and the nitrogen content of the hydrogenated crude oil product.

TABLE 3

| Temp. ° C. | Acid number mg KOH/g | Metal content ppm | Sulphur content ppm | Nitrogen content ppm |
|---|---|---|---|---|
| 230 | 0.15 | 7.8 | 4468 | 558 |
| 250 | 0.07 | 5.9 | 4270 | 539 |
| 300 | 0.06 | 3.1 | 3102 | 524 |
| 350 | 0.39 | 1.3 | 1176 | 481 |

Even when the crude oil is hydrogenated at 50 bars, a strong reduction of the acid number is achieved at 230° C., with a concurrent reduction of the metal content from 10 ppm to 7.8 ppm. The tendency of the results at increasing temperature is approximately the same as for the hydrogenation at 20 bars in Example 1.

What is claimed is:

1. A process for removing essentially naphthenic acids from a crude oil, the process comprising hydrogenating the crude oil, at a temperature of 100° C. to 300° C. and at a pressure of 1 to 50 bars, over a catalyst consisting of nickel-molydenum or cobalt-molydenum on alumina as a carrier material.

2. The process according to claim 1 wherein the crude oil that is hydrogenated is a crude oil from which a naphtha fraction has been distilled.

3. The process according to claim 1 wherein the crude oil that is hydrogenated is a crude oil from which a naphtha fraction has been distilled.

4. The process according to claim 1, wherein the crude oil is hydrogenated at 20–30 bars and 200–250° C.

5. The process according to claim 3, wherein the crude oil is hydrogenated at 20–30 bars and 200–250° C.

6. The process according to claim 1, wherein the catalyst has a porosity in the range of 10 to 12 nanometers.

7. The process according to claims 5, wherein the catalyst has a porosity in the range of 10 to 12 nanometers.

8. The process according to claim 1, wherein during the hydrogenation the crude oil is fed at a flow rate of 0.5–5.0 $m^3$ of oil per $m^3$ of catalyst per hour.

9. The process according to claim 7, wherein during the hydrogenation the crude oil is fed at a flow rate of 0.5–5.0 $m^3$ of oil per $m^3$ of catalyst per hour.

10. The process according to claim 8 wherein the crude oil is fed at a flow rate of 1.0–3.0 $m^3$ of oil per $m^3$ of catalyst per hour.

11. The process according to claim 9 wherein the crude oil is fed at a flow rate of 1.0–3.0 $m^3$ of oil per $m^3$ of catalyst per hour.

12. The process according to claim 1, wherein the crude oil that is hydrogenated is a crude oil that has been desalted.

13. The process according to claim 11, wherein the crude oil that is hydrogenated is a crude oil that has been desalted.

14. The process according to claim 1, wherein the crude oil is hydrogenated in one or more reactors having a fixed catalyst bed.

15. The process according to claim 13, wherein the crude oil is hydrogenated in one or more reactors having a fixed catalyst bed.

16. The process according to claim 1, wherein the crude oil that is hydrogenated is a crude oil that is to be subjected to a refining process, the crude oil has been desalted and heated to 100–300° C., and, after being hydrogenated, the crude oil is recycled to the refining process for further heating and feeding into the distillation column.

17. The process according to claim 15, wherein the crude oil that is hydrogenated is a crude oil that is to be subjected to a refining process, the crude oil has been desalted and heated to 100–300° C., and, after being hydrogenated, the crude oil is recycled to the refining process for further heating and feeding into the distillation column.

18. The process of claim 1 wherein the crude oil has been desalted and heated to 230–250° C.

19. The process of claim 17 wherein the crude oil has been desalted and heated to 230–250° C.

20. The process according to claim 1, wherein the crude oil that is hydrogenated is a crude oil from which a naphtha fraction has been distilled, and wherein the hydrogenated crude oil is mixed with said distilled naphtha fraction.

21. The process according to claim 19, wherein the crude oil that is hydrogenated is a crude oil from which a naphtha fraction has been distilled, and wherein the hydrogenated crude oil is mixed with said distilled naphtha fraction.

22. A process according to claim 1, wherein the hydrogenation is carried out at a temperature sufficiently high to substantially reduce the metal content and sulphur content of the crude oil.

23. A process according to claim 21, wherein the hydrogenation is carried out at a temperature sufficiently high to substantially reduce the metal content and sulphur content of the crude oil.

* * * * *

UNITED STATES PATENT AND TRADEMARK OFFICE

CERTIFICATE OF CORRECTION

PATENT NO. : 6,063,266
DATED : May 16, 2000
INVENTOR(S) : Grande et al.

It is certified that error appears in the above-identified patent and that said Letters Patent is hereby corrected as shown below:

Title page,
Delete the entire section entitled "References Cited" and substitute therefor

-- References Cited

U.S. PATENT DOCUMENTS

| | | |
|---|---|---|
| 2,734,019 | 2/1956 | Miller et al. |
| 2,921,023 | 1/1960 | Holm |
| 3,488,716 | 1/1970 | Eng |
| 3,876,532 | 4/1975 | Plundo et al. |

FOREIGN PATENT DOCUMENTS

| | | |
|---|---|---|
| 0 208 361 A2 | 1/1987 | EPO |
| 1,326,946 | 8/1973 | United Kingdom --; |

Column 2,
Line 35, delete "30".

Signed and Sealed this

Second Day of October, 2001

*Attest:*

Nicholas P. Godici

NICHOLAS P. GODICI
*Acting Director of the United States Patent and Trademark Office*

*Attesting Officer*